US008297736B2

(12) United States Patent
Gouch et al.

(10) Patent No.: US 8,297,736 B2
(45) Date of Patent: Oct. 30, 2012

(54) INKJET HEAD SUPPORT ASSEMBLY

(75) Inventors: Martin Philip Gouch, Hertfordshire (GB); Joseph Lathbury, Middlesex (GB); Jag Pankhania, Middlesex (GB)

(73) Assignee: FFEI Limited, Herts (GB)

( * ) Notice: Subject to any disclaimer, the term of this patent is extended or adjusted under 35 U.S.C. 154(b) by 265 days.

(21) Appl. No.: 12/860,751

(22) Filed: Aug. 20, 2010

(65) Prior Publication Data

US 2012/0044296 A1 Feb. 23, 2012

(51) Int. Cl.
*B41J 2/15* (2006.01)

(52) U.S. Cl. ..... 347/42; 347/49

(58) Field of Classification Search ..... 347/13, 347/42, 49

See application file for complete search history.

(56) References Cited

U.S. PATENT DOCUMENTS

| | | | | |
|---|---|---|---|---|
| 7,946,684 | B2 * | 5/2011 | Drury et al. | 347/49 |
| 8,182,069 | B2 * | 5/2012 | Cellura et al. | 347/49 |
| 2008/0011874 | A1 | 1/2008 | Munagavalasa et al. | |

* cited by examiner

*Primary Examiner* — Lamson Nguyen
(74) *Attorney, Agent, or Firm* — Kenyon & Kenyon LLP

(57) ABSTRACT

An inkjet head support assembly comprises a plurality of spaced apart carrier members mounted for relative movement along an elongate path, each carrier member including laterally offset first and second coupling positions. In use alternate inkjet heads are coupled at each of their ends between first coupling positions or between second coupling positions respectively of successive pairs of carrier members. At least one coupling position of each carrier member includes an adjustment mechanism to enable parts of inkjet heads coupled to the respective coupling positions of the same carrier member to be relatively aligned in the elongate direction.

9 Claims, 6 Drawing Sheets

INKJET HEAD SUPPORT ASSEMBLY

FIELD OF THE INVENTION

The invention relates to an inkjet head support assembly, an assembly with a plurality of inkjet heads mounted thereon, and a method of replacing an inkjet head in such an assembly.

BACKGROUND OF INVENTION

Conventional inkjet heads have .a relatively small lateral dimension of about 10 cm within which a large number, for example 1000, of inkjet nozzles are provided. Consequently, in a typical single pass inkjet printer, it is necessary to provide several inkjet heads across the width of the page to be printed in order to achieve full coverage. Since the heads incorporate a housing and fixing members at each end, it is not possible to butt the heads end to end and achieve full coverage of inkjet nozzles. Instead, they are typically arranged in a castellated format as shown for example in FIG. 6 of US-A-2008-011874, incorporated herein by reference.

When it is necessary to change an inkjet head in a multi-head machine, such as when a head fails, the new head must be fitted into the place of the old head and the ease with which this can be done depends upon the tolerance within which the new had has been manufactured. In practice, it is common for the tolerance on separation between the heads to be smaller than the tolerance of the head width itself.

If the width (or length in the lateral direction) of the new head is outside the width of the original head plus the allowed tolerance then it is not possible simply to replace the original head with the new head. Instead, it is necessary to adjust the positions of the adjacent heads to compensate. This is a time consuming process requiring each of the adjacent heads to be loosened, adjusted and re-fixed which requires a significant amount of trial and error to ensure that the heads are fully aligned after re-fixing.

SUMMARY OF THE INVENTION

In accordance with the written invention, we provide an inkjet head support assembly comprising a plurality of spaced apart carrier members mounted for relative movement along an elongate path, each carrier member including laterally offset first and second coupling positions whereby in use alternate inkjet heads are coupled at each of their ends between first coupling positions or between second coupling positions respectively of successive pairs of carrier members, at least one coupling position of each carrier member including an adjustment mechanism to enable parts of inkjet heads coupled to the respective coupling positions of the same carrier member to be relatively aligned in the elongate direction.

With this invention, instead of mounting the heads to a fixed support, we provide a plurality of spaced apart carrier members mounted for relative movement along an elongate path. The carrier members are linked together via respective inkjet heads in use so that when one head is replaced, adjustment of a carrier member fixed to the head cause automatic movement of other carrier members connected to the one carrier member. Since each carrier member is connected to two inkjet heads which are aligned, that alignment is maintained even though the carrier member itself moves.

Typically, only one of the coupling positions of each carrier member is provided with an adjustment mechanism although it is, of course, possible that both are provided with adjustment mechanisms.

A variety of different adjustment mechanisms could be provided. One example is a cam arrangement whereby rotation of the cam arrangement causes relative movement in the elongate direction between an inkjet head fixing location and the carrier member. Another example is provided by an elongate slot in the carrier member extending in the elongate direction.

Although the invention is primarily concerned with allowing adjustment in the elongate direction, it is also sometimes useful to be able to adjust the inkjet head fixing locations transverse, for example orthogonal, to the elongate direction and in that case, the adjustment mechanism is preferably adapted to cause such a movement.

The carrier members can be mounted for relative movement along the elongate direction in a variety of ways. For example, they could be mounted to a support via a rack and pinion arrangement, rollers or the like. Conveniently, the carrier members are slidably mounted to at least one support for movement in the elongate direction. In order to reduce the risk of movement of the carrier members transverse to the elongate direction, they are preferably are slidably mounted to a pair of parallel and opposed elongate rails.

BRIEF DESCRIPTION OF THE DRAWINGS

Some examples of assemblies and methods according to the invention will now be described with reference to the accompanying drawings, in which:—

DETAILED DESCRIPTION OF EMBODIMENTS

Figure 1:
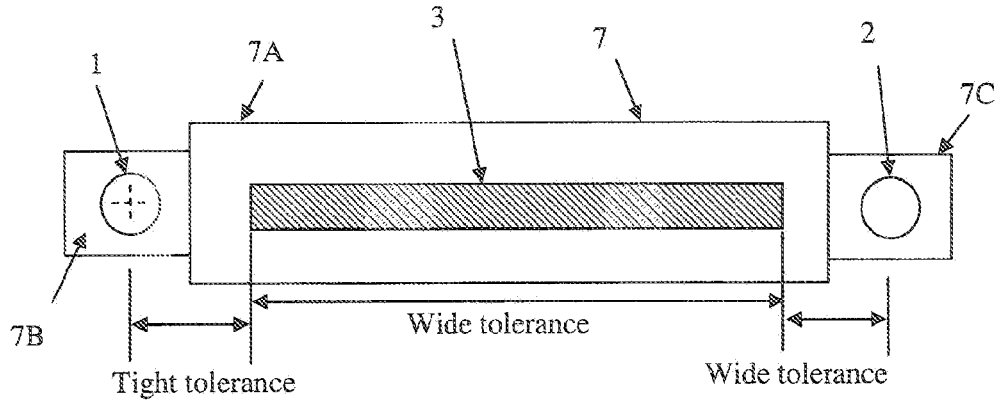
FIG. 1 is a schematic diagram of an inkjet head.

A schematic view of a typical print head 7 is shown in FIG. 1, the head having a main body 7A and end fixture supports 7B, 7C. A row of inkjet nozzles (not shown) is provided in a printing region 3 extending in a line. A pair of apertures 1, 2 are provided in the end fixture supports 7B, 7C respectively. When mounted, a datum pin is inserted through the aperture 1 and another locating pin through the aperture 2. All the inkjet heads described below are constructed in a similar manner.

When manufactured, inkjet print heads of this type are made with a tight tolerance between the centre of the aperture 1 and the adjacent end of the print region 3 while a wider tolerance is permitted between the other end of the print region 3 and the centre of the aperture 2. In addition, the length of the print region 3 is made with a relatively wide tolerance. In this context, a tight tolerance means in the order of 5 microns and a wide tolerance in the order of 20 microns.

Figure 2:
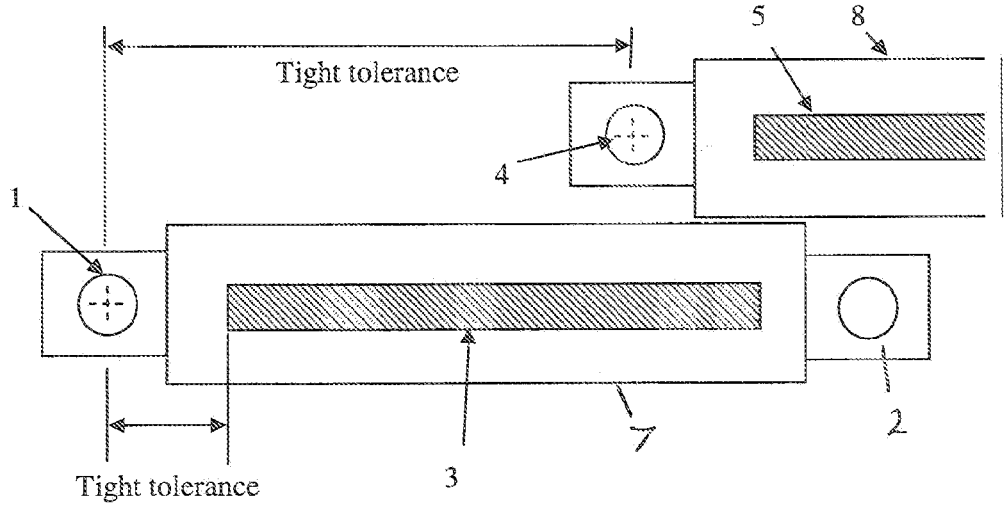
FIG. 2 illustrates the alignments and tolerances required between adjacent inkjet heads.
Figure 6:
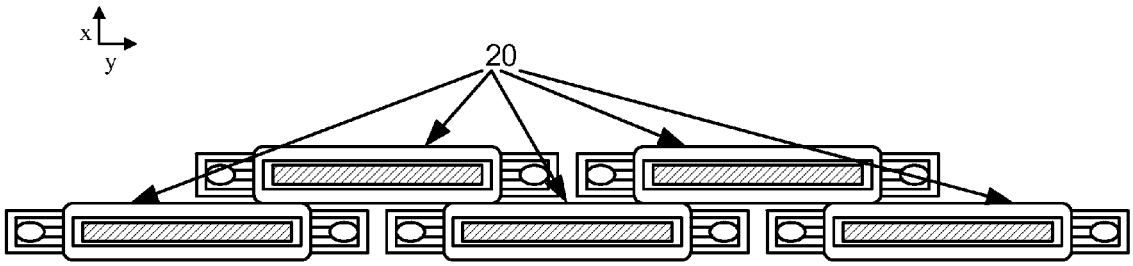
FIG. 6 illustrates a conventional castellated arrangement of inkjet heads in a single pass printer.

When the heads are mounted to a support assembly it is important to have effective continuity between successive print regions as shown in FIG. 6. FIG. 2 illustrates in more detail two inkjet heads as they would appear when mounted. It will be seen that the right most end of a print region 3 of the inkjet head 7 is exactly aligned with the leftmost end of a print region 5 of a further head 8. This is achieved by locating the aperture 1 and the corresponding aperture 4 of the inkjet printhead 8 a distance apart to a very tight tolerance.

Figure 4:
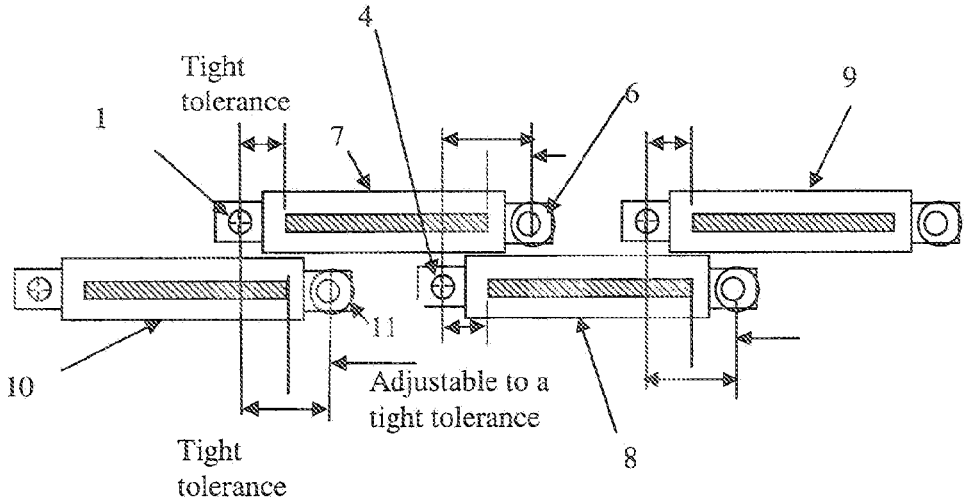
FIG. 4 illustrates four inkjet heads mounted on a support assembly according to an example of the invention.

As explained above, a problem arises in conventional mounting arrangements when it is necessary to replace one of the heads. Thus, although there is a tight tolerance between the centre of the aperture 4 and the adjacent end of the print region 5 of the inkjet head 8, there is a wider tolerance at the other end of the head (FIG. 4) which means that the rightmost end of the print region 5 may not be sufficiently aligned with the leftmost end of the next inkjet head 10.

Figure 5:
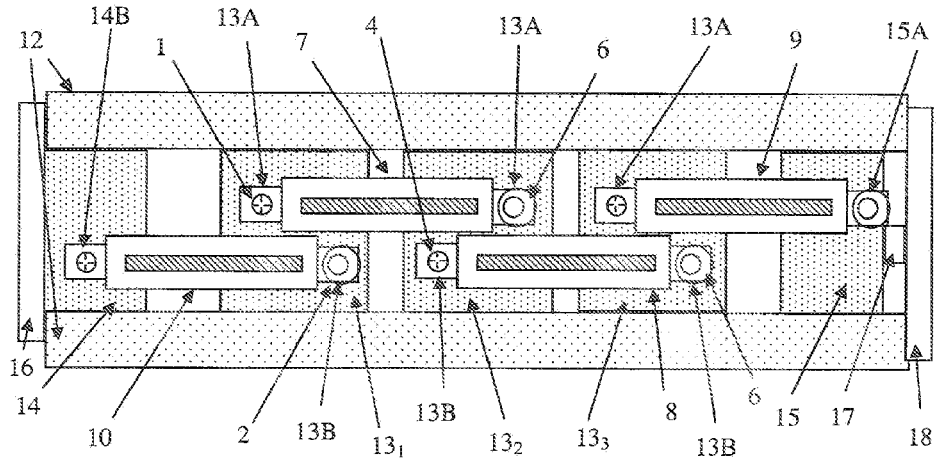
FIG. 5 illustrates the example of FIG. 4 in more detail.

In order to overcome this problem we have devised a new embodiment which is shown in FIG. 5. In this assembly, a pair of side rails 12 are provided extending parallel with each other and supporting between them a number of carrier members $\mathbf{13}_1$, $\mathbf{13}_2$, $\mathbf{13}_3$, 14, 15. Each carrier member 13 has a first coupling position 13A and a second coupling position 13B, typically defined by respective apertures. The end carrier member 14 has a single "second" coupling position 14B and the end carrier member 15 has a single "first" coupling position 15A.

As can be seen in FIG. 5, the inkjet head 7 is fixed between the first coupling position 13A of adjacent carrier members $\mathbf{13}_1$, $\mathbf{13}_2$ while the inkjet head 8 is connected between respective second coupling positions 13B of adjacent carrier members $\mathbf{13}_2$, $\mathbf{13}_3$. In addition the inkjet head 10 is connected between the second coupling positions 13B, 14B of the adjacent carrier members $\mathbf{13}_1$, 14 while an inkjet head 9 is connected between first coupling positions 13A, 15A of adjacent carrier members $\mathbf{13}_3$, 15.

When disconnected from the inkjet heads, the carrier members 13 are slidable in the elongate direction between the rails 12. A number of methods are provided to enable this to be achieved as will be described below.

When an inkjet head is to be replaced, for example the inkjet head 7, the old head is removed by removing the datum pin and locating pin of that head from the respective apertures and carrier members $\mathbf{13}_1$, $\mathbf{13}_2$.

The new head is then offered up to the support assembly and first the end fixture support 7B of that new head is secured to the first coupling position 13A of the respective carrier member 13. The other end fixture support 7C of the inkjet head 7 is then connected to the vacant first coupling position 13A of the adjacent carrier $\mathbf{13}_2$ via an adjustment mechanism 6 examples of which are to be described below. The adjustment mechanism 6 allows the location of the centre of the aperture 2 of the head 7 to be adjusted in the longitudinal or elongate direction relative to the associated carrier member $\mathbf{13}_2$. Since the inkjet head 8 is already secured to the carrier member $\mathbf{13}_2$, and the inkjet heads 9, 10 are already secured to their respective carrier members, any adjustment of the location of the aperture 2 relative to the carrier member $\mathbf{13}_2$ will result in that carrier member $\mathbf{13}_2$ being moved (slid) to the right in FIG. 5 so that the alignment of the remaining inkjet heads remains unchanged.

Figure 3:
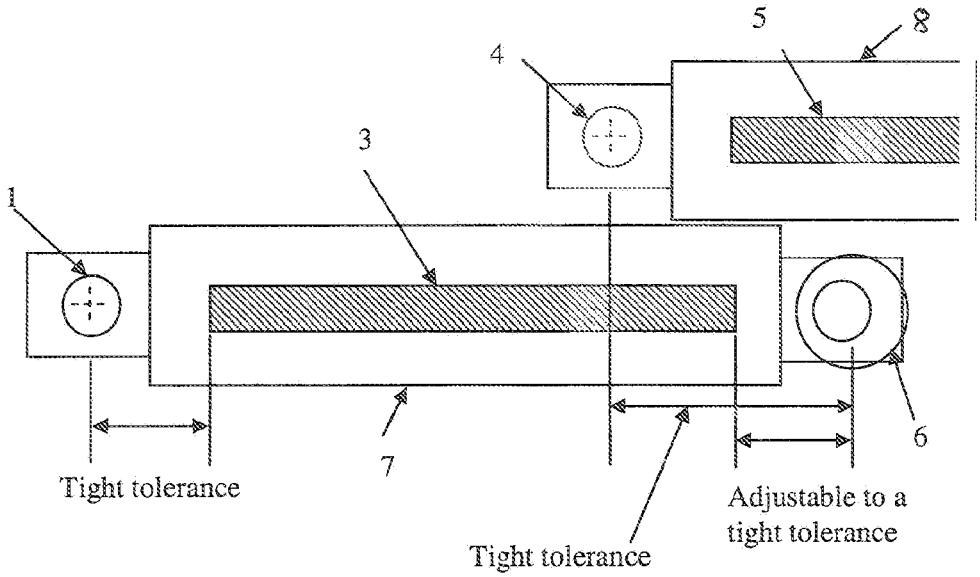
FIG. 3 is a view similar to FIG. 2 but illustrating an example of the invention.

In summary, we now treat both locating pins as a datum pin but only for the end of the print region they are closest to (FIG. 3). To achieve this the non-datum locating pin needs to be placed into the intermediate adjustment mechanism 6 which is adjusted to a tight tolerance to the end of the printing region. This adjustment mechanism carrier 6 is then located to a tight tolerance to the datum pin 4 of the adjacent head. There is no direct mechanical connection between the datum pins 1 and 4 of the two adjacent heads apart from through the print head print region. Thus when the print head 7 is replaced with another print head the adjacent print head 8 will be adjusted into position with the use of the adjustment mechanism carrier 6. The advantage of this system is that the head 9 adjacent to the adjacent head 8 will automatically retain the correct relationship to the adjacent head 8 and this fixed relationship between heads will be retained for all the remaining heads on the print bar. Also the other adjacent head 10 will retain the correct positional relationship with the new head 7.

It will be noted that although the carrier members 13 can move in an elongate direction, the outer rails 12 prevent movement transversely or indeed a rotation movement.

In this example, end carrier members 14, 15 are provided which do not require any adjustment capability although this could be provided in some cases. Furthermore, in this example, end bars 16, 18 are shown and this allows the carrier members to be held in place under a pre-load exerted by an end bar member 17. Although in this example, an adjustment mechanism 6 is provided for only one of the coupling positions on each inkjet head, adjustment mechanisms could be provided for both. The adjustment mechanism 6 can take a variety of forms and for example may consist of a double concentric pin arrangement as shown in FIG. 7 or a more direct screw or dual thread adjuster.

Figure 7:
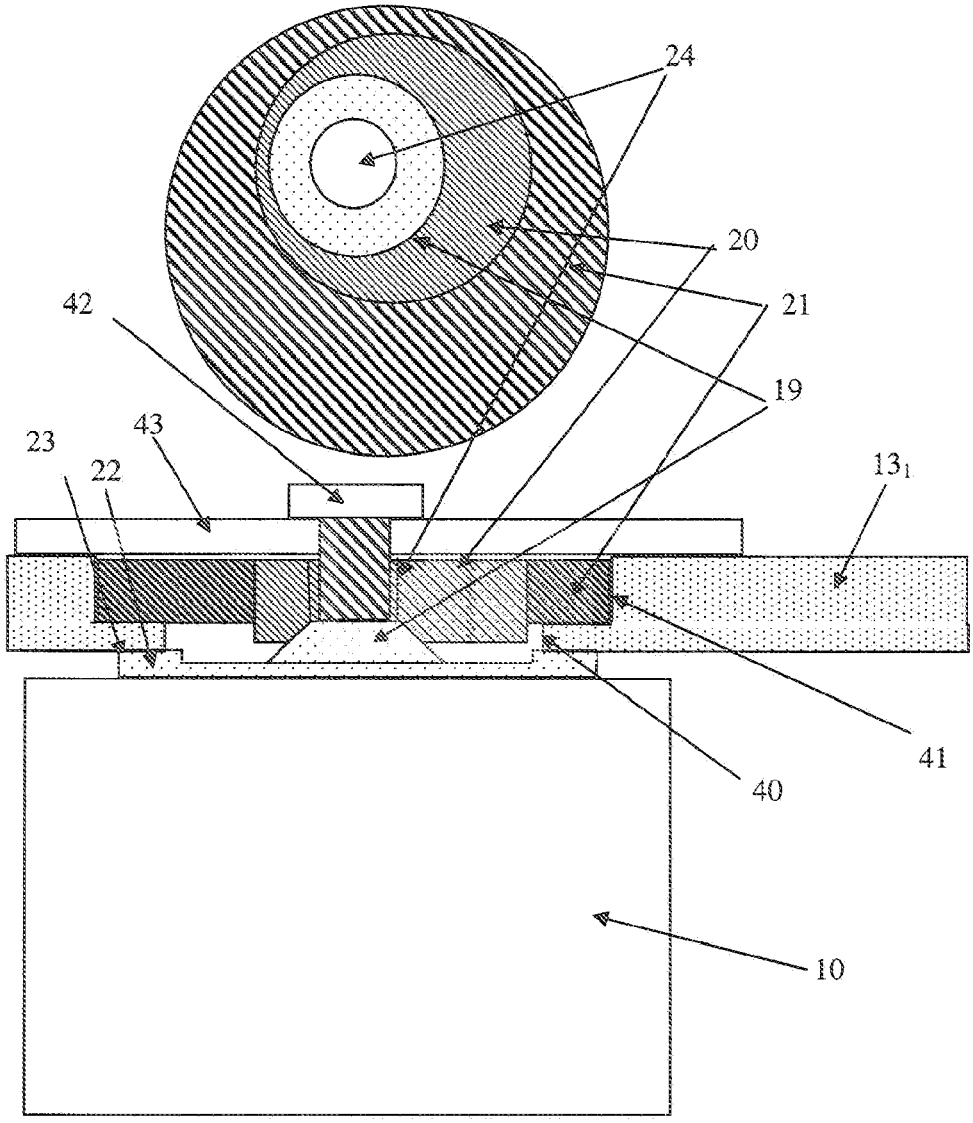
FIG. 7 illustrates a first example of an adjustment mechanism in more detail.

As can be seen (in cross-section) in FIG. 7, the end fixture 2 of the inkjet head 10 is mounted into an aperture 40 of the carrier member $\mathbf{13}_1$. The interface 23 between the carrier member $\mathbf{13}_1$ and the datum face 22 provides control of the height (z) of the inkjet head.

This datum plate 22 has a conic section 19 which acts as the datum in x and y. The conic section 19 then received into a matching eccentric cam 20 which provides adjustment in the x direction. This eccentric cam 20 is then received into a larger eccentric cam 21 which provided adjustment in the y direction. The eccentric cam 21 is received into a circular hole 41 in the carrier member $\mathbf{13}_1$.

It is not a requirement that holes 40 and 41 in the carrier member $\mathbf{13}_1$ are not continuous and the lower part of the carrier member $\mathbf{13}_1$ which is adjacent to hole 40 is not required to be the same component as the upper part of the carrier member $\mathbf{13}_1$ which is adjacent to hole 41. These two parts could be made from separate components.

The locating mechanism 2 can then be selectively adjusted by rotating one or both of the cams 20, 21 so as to adjust the position of the inkjet head in the x and y directions and achieve alignment with the head 10 as described above. A securement pin 42 is then inserted through an aperture 24 to fix and clamp 43 the adjustment mechanism and head 7 in position on the carrier member $\mathbf{13}_1$.

Figure 8:
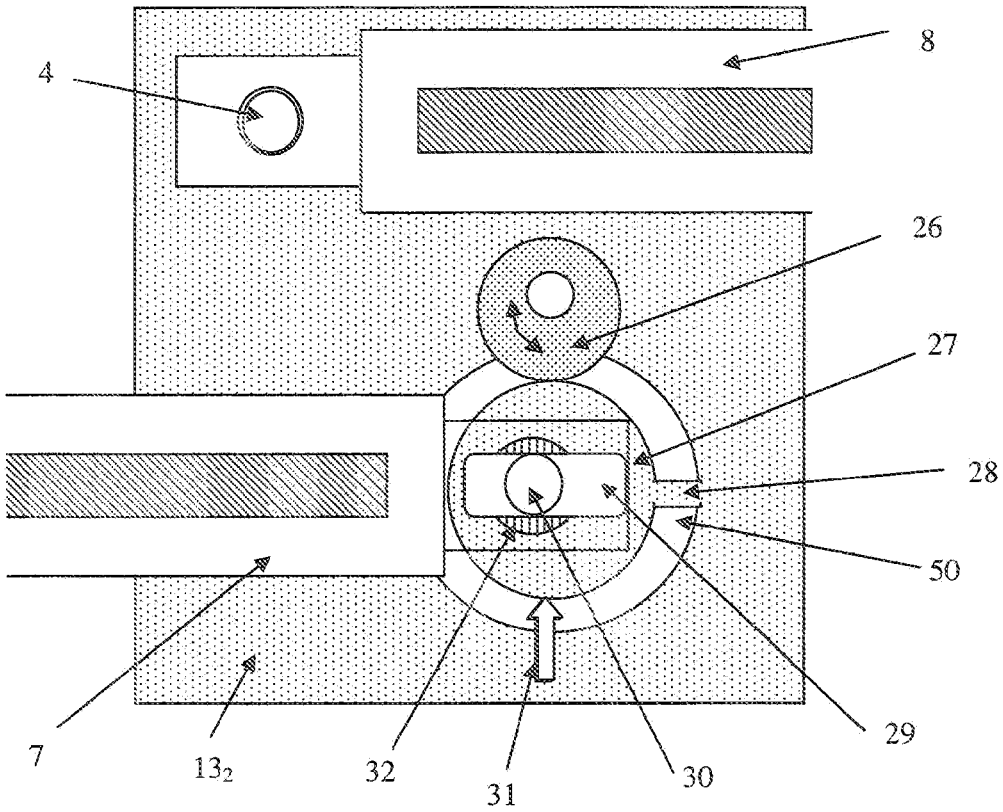
FIG. 8 illustrates a second example of an adjustment mechanism.

An alternative embodiment for the adjustment mechanism is shown in FIG. 8. In this case, the inkjet head 8 is fixed to the carrier member $\mathbf{13}_2$ at the datum coupling position 4. The inkjet head 7 is coupled to the carrier member $\mathbf{13}_2$ via an adjustment mechanism 50. The adjustment mechanism 50 comprises a landing area 27 coupled via a flexible, thin neck or web 28 to the main body of the carrier member $\mathbf{13}_2$. This neck 28 allows for movement in the x direction which is caused by rotation of a cam 26, a bias force being applied at 31 by a spring or screw arrangement (not shown).

The landing area 27 also includes an elongate, rectangular slot 29 extending in the elongate direction so as to permit adjustment of the position of the head 7 relative to the carrier member $13_2$ in the y or elongate direction. The head 7 is secured to the carrier member $13_2$ via a locking nut 32 and a fixing pin 30.

Figure 9:
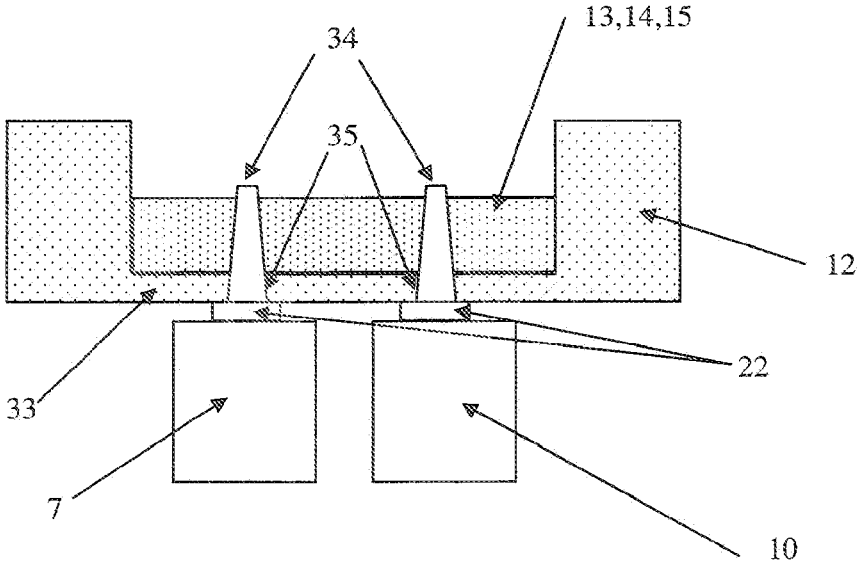
FIG. 9 is a schematic cross-section through a first example of a support assembly; and, FIG. 10 is a cross-section through a second example of a support assembly.

FIG. 9 illustrates one example of the way in which the carrier members 13, 14, 15 can be mounted between the rails 12. In this example, the rails 12 are formed by an integral generally u-shaped body including adjoining plate region 33, the plates 13, 14, 15 slidably resting on the adjoining plate region. The heads 7, 10 are mounted to the carrier members 13-15 as explained above with fixing pins as is shown at 34 extending through slots 35 in the plate region 33, the slots extending along the full length of the plate so as to allow movement in the elongate (y) direction. Vertical positioning is adjusted by means of datum members 22.

Figure 10:
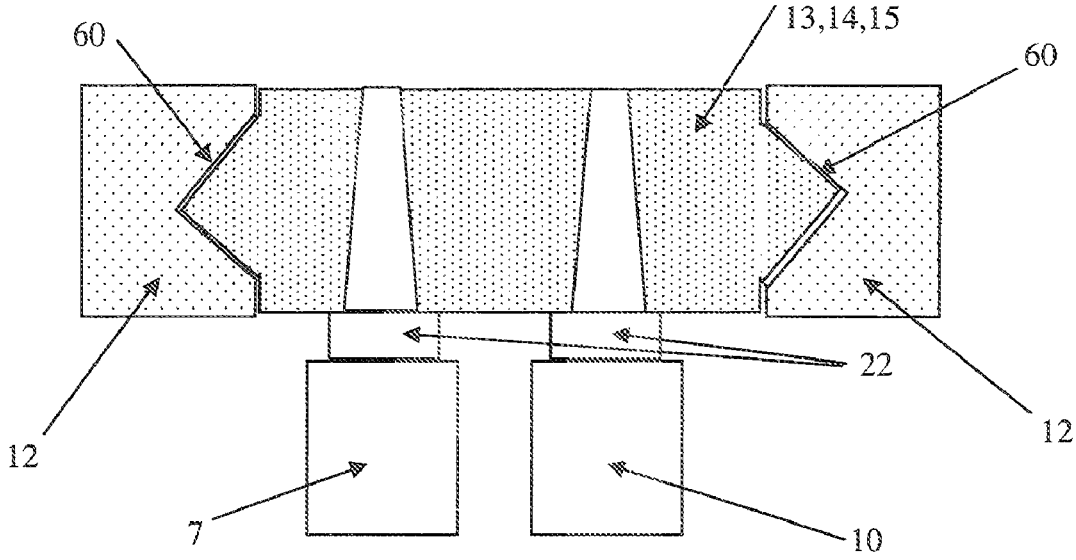

FIG. 10 illustrates an alternative arrangement in which the rails 12 are formed with generally V-shaped grooves 60, the carrier members 13-15 having correspondingly shaped outer edges so that they fit into the groove 60 and can slide there along.

We claim:

1. An inkjet head support assembly comprising a plurality of spaced apart carrier members mounted for relative movement along an elongate path, each carrier member including laterally offset first and second coupling positions whereby in use alternate inkjet heads are coupled at each of their ends between first coupling positions or between second coupling positions respectively of successive pairs of carrier members, at least one coupling position of each carrier member including an adjustment mechanism to enable parts of inkjet heads coupled to the respective coupling positions of the same carrier member to be relatively aligned in the elongate direction.

2. An assembly according to claim 1, wherein the adjustment mechanism is provided at only one of the coupling positions of each carrier member.

3. An assembly according to claim 1, wherein the adjustment mechanism comprises a cam arrangement whereby rotation of the cam arrangement causes relative movement in the elongate direction between an inkjet head fixing location and the carrier member.

4. An assembly according to claim 1, wherein the adjustment mechanism is provided by an elongate slot in the carrier member extending in the elongate direction.

5. An assembly according to claim 1, wherein the adjustment mechanism is adapted to cause movement of an inkjet head fixing location relative to the carrier member transverse, for example orthogonal, to the elongate direction.

6. An assembly according to claim 1, wherein the carrier members are slidably mounted to at least one support for movement in the elongate direction.

7. An assembly according to claim 6, wherein the carrier members are slidably mounted to a pair of parallel elongate rails.

8. An assembly according to claim 1, further comprising a plurality of inkjet heads mounted between respective adjacent pairs of the carrier members.

9. A method of replacing an inkjet head in an inkjet mounting assembly including a plurality of inkjet heads according to claim 8, the method comprising removing an inkjet head from the assembly by disconnecting it from the first coupling positions of the respective carrier members;

fixing one end of a replacement inkjet head to one of the said first coupling positions; and fixing the other end of the replacement inkjet head to the other of the said first coupling positions using an adjustment mechanism so as to align the relative position of the other end of the replacement inkjet head to a further inkjet head coupled to the same carrier member, whereby said adjustment causes movement in the elongate direction of said other carrier member one or more further carrier members secured directly or indirectly thereto by an inkjet head.

* * * * *